United States Patent [19]

Steinbach

[11] 4,446,709

[45] May 8, 1984

[54] CYLINDER LOCK MECHANISM

[75] Inventor: Robert L. Steinbach, Glendale Heights, Ill.

[73] Assignee: Chicago Lock Co., Chicago, Ill.

[21] Appl. No.: 283,226

[22] Filed: Jul. 14, 1981

[51] Int. Cl.[3] ..... E05B 17/14; E05B 27/08

[52] U.S. Cl. ..... 70/363; 70/419; 70/422; 70/424

[58] Field of Search ..... 70/363, 350, 351, 362, 70/417, 421–424, 419

[56] References Cited

U.S. PATENT DOCUMENTS

| | | | |
|---|---|---|---|
| 167,088 | 8/1875 | Felter | 70/419 |
| 180,255 | 7/1876 | Miller . | |
| 225,808 | 3/1880 | Deitz . | |
| 419,091 | 1/1890 | Williams . | |
| 1,234,212 | 7/1917 | Renaux | 70/363 |
| 1,484,831 | 2/1924 | Hurd | 70/417 |
| 2,021,443 | 11/1935 | Deutsch | 70/363 |
| 2,036,747 | 4/1936 | Fitzgerald . | |
| 2,225,703 | 12/1940 | Machinist | 70/417 |
| 2,391,834 | 12/1945 | Johnstone | 70/363 |
| 2,690,070 | 9/1954 | Spain | 70/363 |
| 2,831,338 | 4/1958 | Spain | 70/364 |
| 2,949,762 | 8/1960 | Johnstone . | |
| 3,408,840 | 11/1968 | Hasenbein | 70/363 |
| 3,455,130 | 7/1969 | Basseches | 70/421 |
| 3,509,748 | 5/1970 | Trainor . | |
| 3,604,231 | 9/1971 | Buschi . | |
| 3,733,863 | 5/1973 | Toepfer . | |
| 3,795,123 | 3/1974 | Stiffel | 70/417 |
| 4,099,395 | 7/1978 | Garza | 70/417 X |
| 4,104,898 | 8/1978 | Fois | 70/423 X |
| 4,195,502 | 4/1980 | Best et al. | 70/422 X |
| 4,377,940 | 3/1983 | Hucknall | 70/419 X |

FOREIGN PATENT DOCUMENTS

| | | | |
|---|---|---|---|
| 2380395 | 10/1978 | France | 70/417 |

OTHER PUBLICATIONS

Medeco "Security Inner Cylinders," Publication of Medeco Security Locks, Inc., Salem, Virginia, Printed 11-75, Cover page and p. 1C.

*Primary Examiner*—Gary L. Smith
*Assistant Examiner*—Lloyd A. Gall
*Attorney, Agent, or Firm*—Gerlach & O'Brien

[57] ABSTRACT

A cylinder lock mechanism includes a tubular barrel, a lock cylinder rotatable in the barrel, tumblers longitudinally and reciprocally movable within the cylinder, a cap on a front end of the barrel and having a key opening therethrough, a facing member interposed between the cap and the cylinder and having an opening registering with the cap opening, a spacer interposed between the facing member and the cylinder and having an opening registering with the cap opening, such openings when in registry receiving a key for insertion thereof into engagement with the tumblers, an engagement member extending transversely of the cylinder for engagement with the tumblers and laterally movable to and from the tumblers, a locking member extending longitudinally of the cylinder for engagement with the engagement member and laterally movable to and from the tumblers, structure on the cylinder and the barrel respectively for engaging the locking member therealong for locking purposes, structure on the tumblers for engaging the engagement member to support the locking member in a projecting position with respect to the cylinder for locking purposes, and structure on the tumblers permitting the engagement member to move towards the tumblers, thereby to permit retraction of the locking member from the projecting position for unlocking purposes, the engagement member and the locking member being free-floating in the lock mechanism with respect to the cylinder and to the barrel.

36 Claims, 25 Drawing Figures

CYLINDER LOCK MECHANISM

BACKGROUND OF THE INVENTION

This invention relates to cylinder lock mechanisms, more particularly, to mechanisms of the so-called "side bar" type. In further particular, the invention relates to such lock mechanisms in which tumblers are received in a lock cylinder for reciprocal longitudinal movement therein, in the direction of the cylinder axis.

Cylinder lock mechanisms of the side bar type long have been provided. Characteristically, they employ a lock member which is alternately projected from a lock cylinder and retracted for locking and unlocking purposes, respectively, with the locking member engaging a barrel in which the cylinder rotates, for locking purposes. The prior lock mechanisms have both advantages and disadvantages: in particular, their resistance to picking or forcing may be limited.

SUMMARY OF THE INVENTION

An important object of the present invention is to provide a cylinder lock mechanism having outstanding resistance to picking and improved resistance to forcing and other types of attack. An accompanying object is to provide such characteristics in a relatively small lock mechanism, such as may be employed in vending machines, alarm systems, and similar environments, wherein the lock mechanisms frequently are subjected to unauthorized picking attempts and severe abuse.

Another important object is to provide a lock mechanism having the foregoing characteristics and which is well-suited for commercial manufacture and sale, being capable of manufacture and assembly relatively simply and economically, so that, as a practical matter, it may be incorporated by users in their equipment at acceptable costs.

In the invention, a cylinder lock mechanism is provided, the overall combination of which includes a tubular barrel, a lock cylinder received in the barrel for rotation about the longitudinal axis of the cylinder and having tumbler bore-forming means extending longitudinally therein, a plurality of tumblers received in the bore-forming means for reciprocal longitudinal movement therein, a cap secured to a front end of the barrel and having an opening for insertion of a key therethrough, a discrete facing member received in the barrel for rotation about the cylinder axis and interposed between the cap and the cylinder, the facing member having an opening arranged for registry with the cap opening and with the bore-forming means and comprising a hard material resistant to drilling, a discrete spacer received in the barrel for rotation about the cylinder axis and interposed between the facing member and the cylinder, the spacer having an opening arranged for registry with the cap opening and with the bore-forming means, such openings when in registry receiving a key for insertion thereof into engagement with the tumblers, an engagement member extending transversely of the cylinder for engagement with the tumblers and laterally movable to and from the tumblers, an elongated locking member extending longitudinally of the cylinder for engagement with the engagement member and laterally movable to and from the tumblers, means on the cylinder and the barrel respectively for engaging the locking member along its length for locking purposes, means on each of the tumblers for engaging the engagement member to support the locking member in a projecting position with respect to the cylinder for locking purposes, and means on each of the tumblers permitting the engagement member to move towards the tumblers, thereby to permit retraction of the locking member from the projecting position for unlocking purposes, the engagement member and the locking member being free-floating in the lock mechanism with respect to the cylinder and to the barrel.

As will be apparent from the disclosure, the overall combination of the invention embodies subcombinations of elements which are independently useful. Additionally, various elements of the invention provide advantages and improvements, and constitute features of the invention, as will appear on reference to the specification and to the attached drawings.

BRIEF DESCRIPTION OF THE DRAWINGS

The attached drawings illustrate preferred embodiments of the invention, without limitation thereto. In the drawings, like elements are identified by like reference symbols in each of the views, and.

DESCRIPTION OF THE PREFERRED EMBODIMENTS

Figures 1, 2, 3, 4, 5, 6, 7:
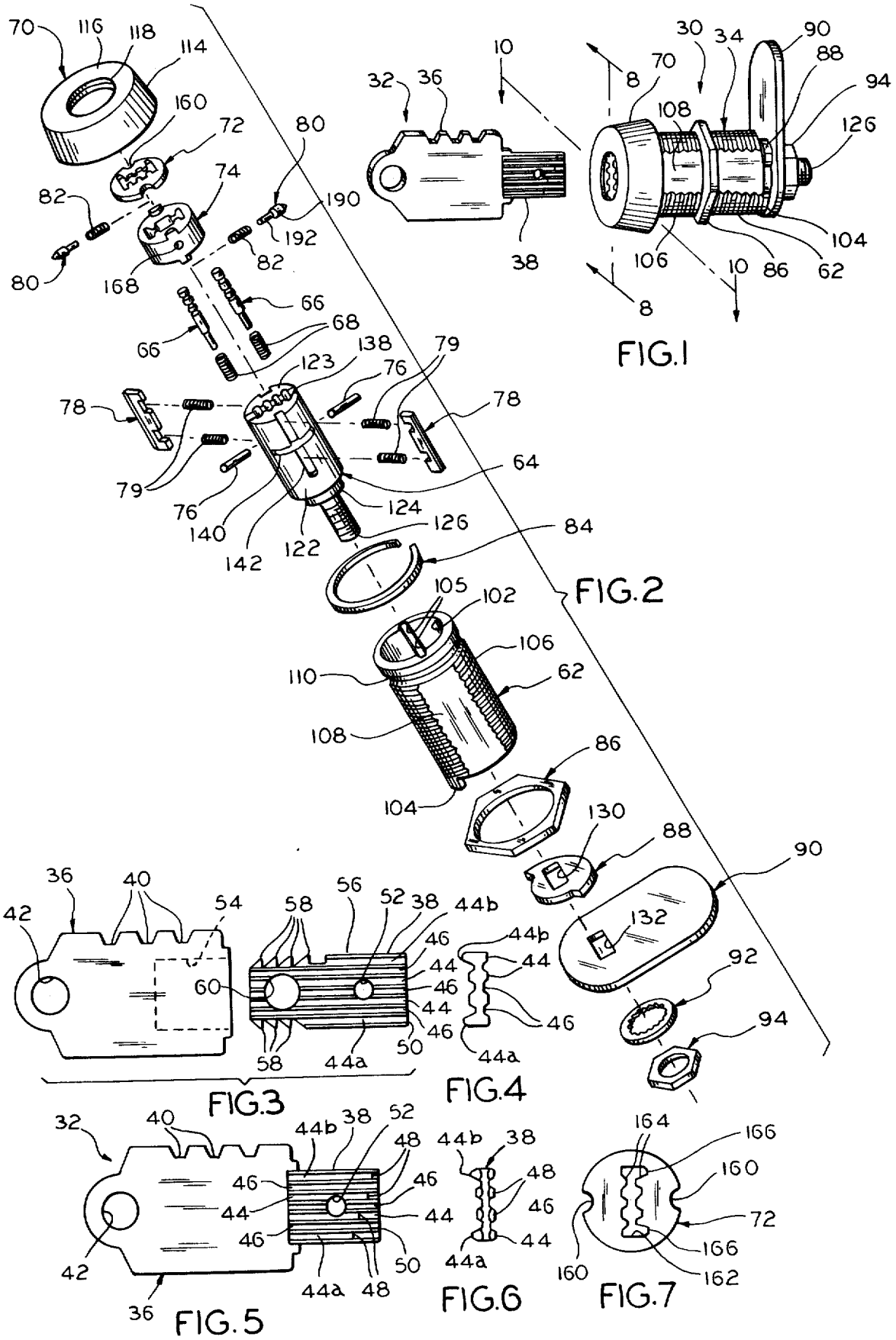
FIG. 1 is a perspective view of a cylinder lock mechanism and a key therefor in accordance with the invention.
FIG. 2 is an exploded perspective view of the lock mechanism of FIG. 1.
FIG. 3 is a side elevational view of a key handle and a partly formed key shank prior to milling and assembly into the key illustrated in FIG. 1, which there is shown on a smaller scale.
FIG. 4 is an end elevational view of the shank before milling.
FIG. 5 is a side elevational view of the completed key.
FIG. 6 is an end elevational view of the shank thereof.
FIG. 7 is an elevational view of a facing member in the lock mechanism, on a similar scale.

Referring to the drawings, FIG. 1 illustrates a preferred combination of a lock assembly 30 and a key 32 therefor in accordance with the invention. The lock assembly 30 includes a cylinder lock mechanism 34 and additional elements thereon, which cooperate with the lock mechanism in mounting and using the same, as described hereinafter.

Referring also to FIGS. 5 and 6, the key 32 is referred to as a "flat" key, and it includes a flat handle 36 and a flat shank 38 secured thereto. One edge of the handle 36 is provided with a series of transverse grooves 40 for orientation purposes, and a hole 42 is formed in its outer end, for carrying purposes.

The key shank 38 is provided with a series of four parallel longitudinal lands 44 interspersed with three parallel longitudinal grooves 46, on each side of the shank. In the illustrative embodiment, the locations of the lands and grooves on the opposite sides of the shank are alike, so that they are arranged back-to-back on the shank. Two lands 44*a* and 44*b* project laterally outwardly beyond the remaining lands 44 on one side of the shank. The number and location of such projecting lands if any, may be varied from key to key in providing multiple key changes.

Bittings or shoulders 48 are provided in the several lands 44 on both sides of the shank 38, and they are disposed inwardly at various selected distances from the distal end 50 of the shank. A retention hole 52 extends through the shank 38, approximately at its center.

Referring also to FIGS. 3 and 4, the key 32 is constructed of a separate handle of formable material, preferably thermoplastic material, having the orientation grooves 40 and the carrying hole 42 provided therein by suitable means, and also having a rectangular recess 54 formed in the inner end thereof. The key shank 38 is part of a longer roll-formed and stamped piece 56, having the lands 44, the grooves 46, and the retention hole 52 therein. In a preferred embodiment, the bittings 48 are provided by milling the lands 44 inwardly from the distal end 50 of the shank 38. In addition, the blank includes sawtooth-type anchor teeth 58 formed in its opposite longitudinal edges, at the proximal end of the shank 38. An anchoring hole 60 is provided in the piece 56 between the teeth 58.

The key 32 is assembled by inserting the end of the piece 56 having the teeth 58 into the recess 54 in the handle 36, and then forming the handle around the blank. Thus, a plastic handle 36 may be subjected to ultrasonic vibration as the piece 56 is inserted, so that plastic material heated and softened thereby flows around the teeth 58 and into the anchoring hole 60, whereby the blank is fixedly secured within the handle upon cooling. The key 32 and a method of manufacturing the key are disclosed and claimed in my co-pending application Ser. No. 360,886, filed Mar. 23, 1982 (Case No. 11).

Referring to FIG. 2, the lock assembly 30 includes a tubular barrel 62, a lock cylinder 64, a plurality of tumblers 66, of which only a part are shown, coil compression tumbler springs 68, a cap or closure 70, a facing member or plate 72, a spacer 74, two engagement members or bars 76, two locking members or bars 78, which also may be referred to as side bars, two coil compression springs 79 for each locking member, two key-holding or retention members or pins 80, and two coil compression key-holding member springs 82. The lock assembly additionally includes a split expansion ring-type cap fastener 84, a lock-mounting nut 86, a cylinder-stop disc 88, a locking plate or arm 90, a lock washer 92, and a plate-securing nut 94.

Figure 8:
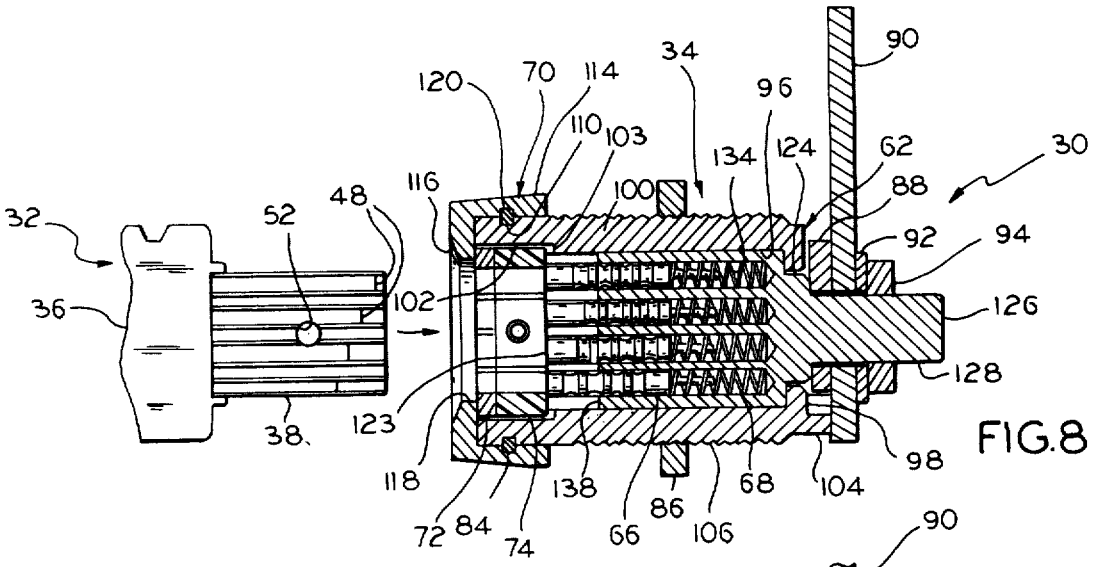
FIG. 8 is a longitudinal sectional view of the lock mechanism in locking condition, taken substantially on line 8—8 of FIG. 1, together with a fragmentary view of the key prior to insertion into the lock mechanism, all on a larger scale than the preceding views.

The barrel 62 is generally similar to the lock barrels employed in various prior cylinder lock mechanisms. Referring to FIG. 8, the barrel 62 has a cylindrical main bore 96 which is partly closed at an inner end thereof by an annular back wall 98 integral with a generally cylindrical side wall 100. A cylindrical counterbore 102 of slightly greater diameter than the main bore 96 is provided at the front end of the barrel 62, to form a shoulder 103 in the side wall 100 at the junction of the bores. An arcuate longitudinal extension 104 of the side wall 100 extends rearwardly from the back wall 98, as is conventional for a lock assembly performing the illustrative locking function.

Referring to FIGS. 2 and 10–15, two longitudinal grooves 105 are formed in the inner surface of the side wall 100 of the barrel 62, in diametrically opposed relation. The grooves extend from the front end of the side wall 100 to locations adjacent to and spaced from the back wall 98. The radius of the bottom of each groove is greater than the radius of the cylinder counterbore 102. Opposed flat side walls 105*a* bound or define the grooves 105 and diverge slightly in the direction of the center of the barrel 62, conforming in this respect to and having but slightly greater width than complementary portions of the locking members 78, as described hereinafter.

Referring to FIGS. 1, 2, and 8–11, the outer surface of the side wall 100 is threaded as indicated at 106, for threaded engagement with the mounting nut 86, and two diametrically-opposed flats 108 are provided on the side wall 100. This structure serves for mounting the lock assembly 30 in a non-circular hole in a cabinet wall or the like, with the barrel 62 being received in the hole and the wall being clamped between the cap 70 and the mounting nut 86, in a conventional manner. A peripheral groove 110 is provided in a smooth or unthreaded external surface of a front end portion of the side wall 100, spaced from and adjacent to the front end surface of the side wall.

Referring to FIGS. 2 and 8, the cap 70 is a one-piece integral structure of a frusto-conical annular skirt or flange 114 and a transverse annular front wall or flange 116 having a slightly concave outer surface. The front wall 116 defines a central circular key-insertion opening 118 in the cap. An annular peripheral groove 120 is provided in a smooth inner surface of the skirt 114, and it is complementary to the peripheral groove 110 in the barrel wall 100. The peripheral grooves 110 and 120 receive the split expansion ring cap fastener 84 in both of them at the same time, to permanently secured the cap 70 rotatably on the front end portion of the side wall 100 of the barrel.

Referring to FIGS. 2 and 8, the lock cylinder 64 is an integral one-piece structure of a cylindrical body 122 having a front face 123, an annular shoulder 124 of reduced diameter on the rear end thereof, and a threaded axial shaft 126 of further reduced diameter extending rearwardly from the shoulder 124 and having two longitudinal flats 128 (see FIG. 11) on opposite sides thereof. The cylinder 64 is received rotatably in the main bore 96 of the barrel 62, with the shoulder 124 of the cylinder journalled in the annular back wall 98 of the barrel, as seen in FIGS. 8–11, and the shaft 126 projecting rearwardly from the back wall. The front face 123 of the cylinder body 122 is spaced forwardly from the side wall shoulder 103.

The shaft 136 may be utilized to perform conventional locking functions in connection with rotation of the cylinder 64 between locked and unlocked positions. In the illustrative embodiment, the stop disc 88 is provided with an oblong mounting opening 130 and the locking plate 90 is provided with a similar mounting opening 132 for reception of the inner end of the shaft 126 therein. The disc and the plate are secured on the shaft 136 for rotation therewith by the lock washer 92 received on the shaft and disposed on the outer face of the plate 90, and the securing nut 94 in threaded engagement with the shaft on the outer side of the lock washer.

The locking plate 90 is rotated between different angular positions with respect to the barrel 62 by rotation of the cylinder 64, alternately to engage and disengage a cabinet member or the like, not shown, for locking and unlocking purposes, in conventional ways. The stop disc 88 alternately engages opposite edges of the rearwardly disposed barrel extension 104 to limit the rotation of the cylinder, in conventional manner. In the illustrative embodiment, rotation of the lock cylinder 64 is limited to 90° in opposite directions. However, other rotational limitations may be set, or the stop structure may be omitted, so that there are no limits on rotation.

Figure 10:
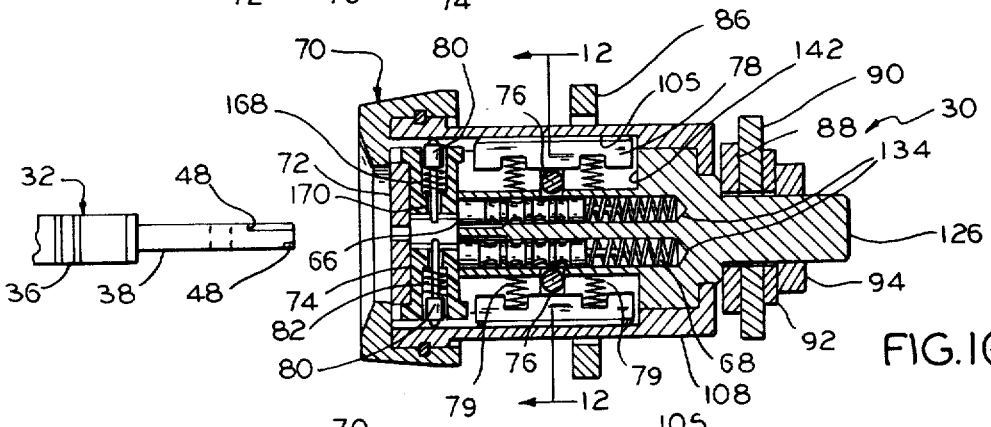
FIG. 10 is a longitudinal sectional view of the lock mechanism in locking condition, taken substantially on line 10—10 of FIG. 1, together with a fragmentary view of the key prior to insertion, on the scale of FIGS. 8 and 9.
Figure 11:
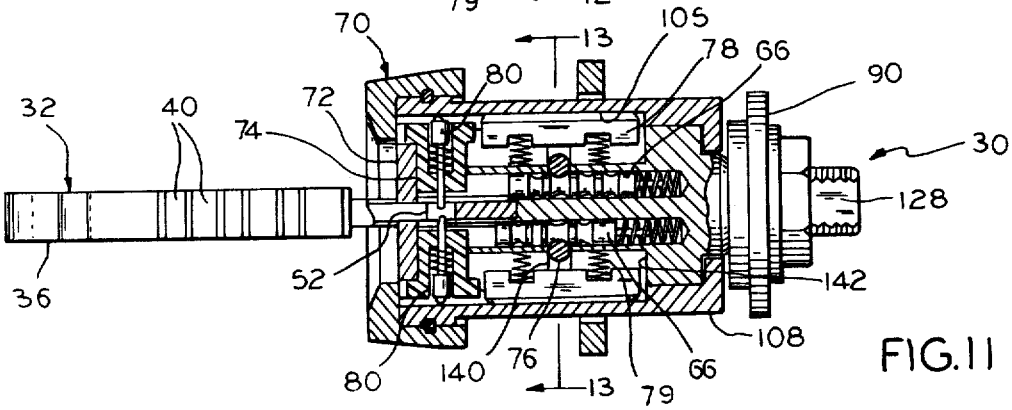
FIG. 11 is a view like FIG. 10 but showing the key inserted in the lock mechanism to place it in condition for unlocking, as in FIG. 9.
Figure 14:
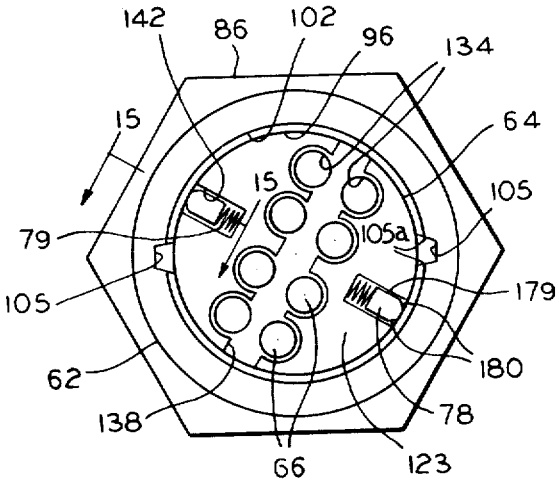
FIG. 14 is a front elevational view of the lock mechanism on the same scale, with parts removed to reveal a lock cylinder thereof.
Figure 12:
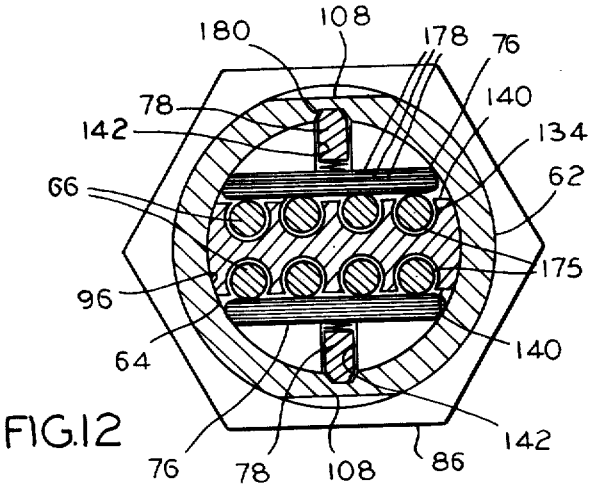
FIGS. 12 and 13 are cross-sectional views of the lock mechanism, taken substantially on line 12—12 of FIG. 10, and line 13—13 of FIG. 11, respectively, and on a larger scale.
Figure 13:
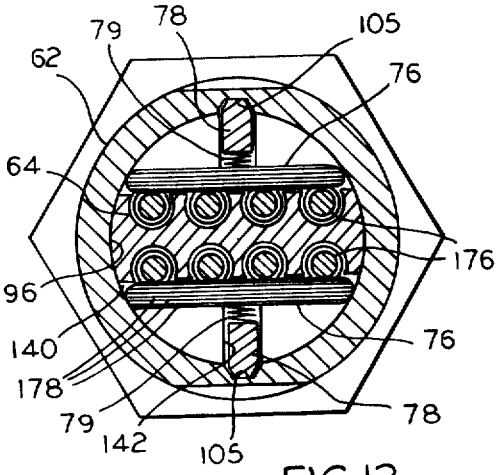

As seen in FIGS. 12–14, the lock cylinder 64 is provided with two spaced apart parallel planar rows of spaced apart cylindrical tumbler bores 134 extending in parallel in the direction of the longitudinal axis of the cylinder. As seen in FIGS. 8–11, the bores 134 are blind bores, which extend from the front face 123 of the cylinder to locations adjacent to and spaced inwardly from the cylinder shoulder 124. A tumbler 66 and a tumbler spring 68 are received in each of the bores 134, for reciprocal longitudinal movement of the tumbler therein.

A diametral slot 138 (FIGS. 2, 8 and 14) extends rearwardly in the axial direction from the front face 123 of the lock cylinder. The slot 138 extends longitudinally for a minor portion of the length of the cylinder body 122, for receiving the key shank 38 therein, as described hereinafter. The slot 138 intersects the walls of the tumbler bores 134, whereby an angularly minor section of the wall of each bore is removed, on the inside of its row of bores. A corresponding angularly minor section of each tumbler 66 is exposed.

Figure 15:
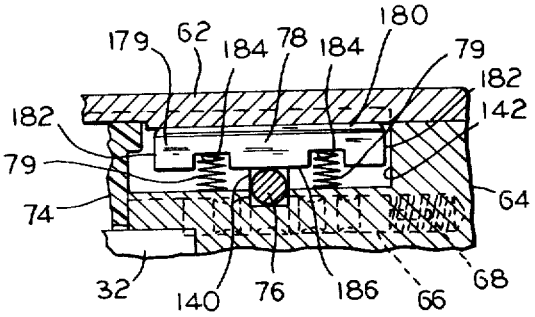
FIG. 15 is a further enlarged fragmentary sectional view taken substantially on line 15—15 of FIG. 14, showing certain elements of the mechanism as they appear in the course of an unlocking procedure.

Referring to FIGS. 2, 11 and 15, two transverse slots 140 are provided in the cylinder body 122, and they extend in the same plane and in diametrically opposed relation, perpendicularly to the longitudinal axis of the cylinder body. The slots 140 are in the shape of segments of a circle, the inner portions of which intersect the walls of the tumbler bores 134 in the manner of chords of a circle, whereby the slots communicate with the tumbler bores 134 and the tumblers 66 therein. An angularly minor, longitudinally narrow section of the side wall of each bore 134 is removed by the provision of one of the slots, on the outside of its row of bores, to expose a corresponding section of each tumbler 66. One of the cylindrical engagement members or bars 76 is received in each of the transverse slots 140 for engagement with the tumblers in one row, such engagement member being laterally movable in the slot to and from the tumblers, as further described hereinafter.

Two longitudinal grooves 142 (FIGS. 2, 11 and 14) are formed in the outer surface of the cylinder body 122, and they extend in diametrically spaced apart parallel relation from the front face 123 of the cylinder to points adjacent to and spaced inwardly from the shoulder 124 at the rear end of the cylinder body. The grooves 142 intersect respective transverse slots 140, to provide communication between the grooves and the engagement members 76 in the slots. One of the locking members 78 is received in each groove 142 for line engagement with the engagement member 76 in the intersecting slot, and the locking member is movable to and from the tumblers 66, as further described hereinafter.

Figure 16:
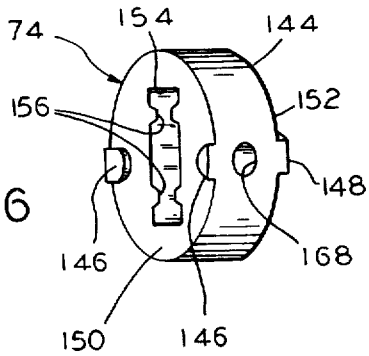
FIG. 16 is an enlarged perspective view of a spacer in the mechanism.

Referring to FIG. 16, the spacer 74 has a cylindrical body 144 and, integral therewith, pairs of diametrically opposed spaced apart front and rear lugs 146 and 148, respectively, projecting forwardly and rearwardly from respective front and rear faces 150 and 152 on the spacer. The lugs 146 and 148 are formed with dissimilar contours, for distinguishing between their front and rear faces. Thus, the lugs 146 on the front face 150 are formed in the outline of segments of a circle, whereas the lugs 148 on the rear face 152 are substantially rectangular in outline. An elongated key-receiving opening 154 is provided in the spacer 74, and it extends in the axial direction between the front and rear faces 150 and 152. The opening 154 is generally rectangular, with, however, four wards 156 extending inwardly of the opening and between the front and rear faces 150 and 152.

The diameter of the spacer 74 is slightly greater than the diameter of the cylinder body 122, and also greater than the diameter of the main bore 96 of the barrel, while being slightly smaller than the diameter of the barrel counterbore 102. Consequently, the spacer 74 is rotatably received in the counterbore 102 (see FIG. 8), but will be prevented from entering into the bore 96 owing to engagement with the annular side wall shoulder 103 at the junction of the bore 96 and the counterbore 102. The rear, rectangular lugs 148 are received in the longitudinal grooves 142 in the cylinder body, which grooves serve as recesses for interlocking engagement of the lugs and the cylinder body. The opening 154 in the spacer provides a keyway which aligns with the slot 138 and adjacent portions of the tumbler bores 134 in the cylinder body 122 (see FIGS. 8–11).

Referring to FIG. 7, the facing member 72 is a relatively thin, substantially circular member having diametrically opposed arcuate notches or recesses 160 provided in its outer periphery. A transversely elongate opening 162 extends in the axial direction through the facing member 72. It may be considered as being formed with a basically rectangular outline, from which wards 164 project inwardly into the opening, and two grooves 166 extend outwardly therefrom in the illustrative embodiment. The diameter of the facing member 72 is the same as that of the spacer 74, for being rotatably received in the barrel counterbore 102. The notches 160 receive the arcuate lugs 146 of the spacer therein, for interlocking engagement of the lugs and the spacer. The opening 162 in the facing member provides a keyway which aligns with the opening 154 in the spacer 74 and the slot 138 in the cylinder body 122.

The facing member 72 and the spacer 74 when received in the counterbore 102 of the barrel are rotatable therein, subject to the interengagement of the spacer lugs 146 and 148 with the facing member 72 and the cylinder body 122, respectively, which serve to orient both the facing member and the spacer. In the preferred illustrative embodiment, the facing member is constructed of hard material resistant to drilling, such as hardened steel, whereas the spacer 74 is constructed of a material, such as a thermoplastic material, which renders it frangible. Accordingly, the lugs 146 and 148, or either of them, are susceptible to being broken off upon torquing of the spacer relative to its adjacent members, whereupon either the facing member 72 or the spacer 74, or both, will become rotatable in the barrel independently and thereby increase the difficulty of picking the lock, as discussed hereinafter.

In the illustrative preferred embodiment, the spacer 74 also is provided with two diametrically opposed radial outer bores 168 that extend inwardly from the cylindrical side surface of the spacer. As seen in FIGS. 10 and 11, a smaller bore 170 extends radially inwardly from each of the outer bores 168. The key-holding members 80 and their springs 82 are received in the outer bores 168, and under certain circumstances, will prevent rotation of the spacer 74, all as discussed hereinafter.

Figure 17:
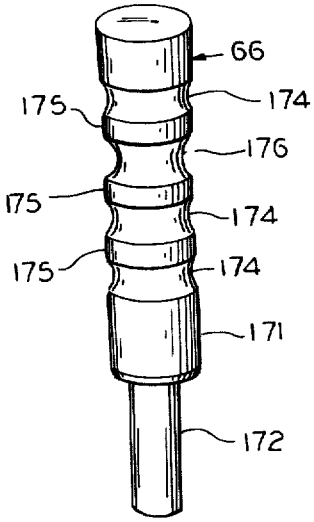
FIG. 17 is an enlarged perspective view of one of the tumblers in the mechanism.

Referring to FIGS. 2 and 17, each tumbler 66 includes a cylindrically-shaped body 171 and a cylindrical stem 172 of reduced diameter extending axially from a rear end of the body. The body 171 in the illustrative embodiment is provided with three spaced apart shallow peripheral arcuate grooves 174, and a relatively deep peripheral arcuate groove 176 which is shaped apart from adjacent shallow grooves 174, all of such grooves having lands 175 interspersed therebetween. The shallow grooves 174 constitute false picking grooves, while the deep groove 176 constitutes an unlocking groove, as explained hereinafter. In assembling the lock mechanism 34, the tumbler springs 68 are inserted in the blind tumbler bores 134, sitting on the closed ends of the bores. The tumblers 66 then are inserted into the bores 134, with their stems 172 first and received within the springs 68.

The engagement members 76 are generally cylindrical, and they are provided with spaced apart longitudinal striations 178 or the like on their outer surfaces, as seen in FIGS. 12 and 13. The engagement members 76 are received in the transverse slots 140 in the cylinder 64, as seen in FIGS. 10–13, where they engage the tumblers 66 in respective rows.

Referring particularly to FIGS. 12–14, each locking member 78 has two parallel elongated planar principal side surfaces 179, from which two outwardly converging planar outer marginal side surfaces 180 extend therealong. The principal side surfaces 179 of each locking member 78 are received in a longitudinal cylinder groove 142 in closely spaced parallel relation to the side walls of the groove, for engagement with the lock cylinder 64 along the length of the locking member, for locking purposes. The marginal side surfaces 180 are complementary to the walls 105*a* of the grooves 105 in the barrel 62, and are received in one of the barrel grooves 105 in closely spaced parallel relation to the groove walls, for engagement with the barrel 62 along the length of the locking member 78, for locking purposes. The opposite ends 182 of the locking members 78 are rounded, for assembly purposes.

Two spaced apart spring-receiving recesses or transverse grooves 184 are provided in the inner edge of each locking member 78. One end of each of the locking member springs 79 is received in one of the recesses 184. Two springs 79 and a locking member 78 from which they extend are received in each longitudinal groove 142 in the cylinder body 122. The two springs for each locking member 78 are seated on the base of the groove 142, on opposite sides of the engagement member 76 received in the adjacent transverse slot 140, and a central portion 186 of the inner edge of the locking member is disposed for line engagement or contact with the engagement member.

In each combination of the locking elements comprised of the engagement members 76 and the locking members 78, an engagement member 76 extends transversely at right angles to the tumblers 66 in engagement therewith. A locking member 78 extends transversely at right angles to the engagement member 76, and thereby substantially parallel to the tumblers 66, for line engagement of the central inner edge portion 186 of the locking member with the engagement member.

The resulting cylinder sub-assembly of the lock mechanism 34 is inserted in the barrel 62 with the shaft 126 leading, as illustrated in FIGS. 8–11. The shaft 126 extends through the annular back wall 98, and the rear face of the cylinder body 122 seats on the inner surface of the back wall 98, with the annular shoulder 124 of the cylinder 64 journalled in the back wall 98, thereby closing the rear end of the lock mechanism. In the locking position of the cylinder 64, the longitudinal grooves 105 in the inner surfaces of the barrel side wall 100 register with respective longitudinal grooves 142 in the cylinder body 122, for receiving a locking member 78 in each pair of registering grooves, in engagement with the cylinder and the barrel along the length of the locking member, for interlocking the cylinder and the barrel. In other dispositions of the lock cylinder 64, rotated relative to the barrel 62, the locking members 78 are received substantially entirely within the cylinder grooves 142, and the outer edges of the locking members engage the wall surface bounding the main bore 96 of the barrel, as seen in FIG. 14.

The key-holding members 80 each include a generally cylindrical body 190 (FIG. 2) havng an outer pointed end, and a reduced diameter stem 192 integral with the inner end of the body. A key-holding member spring 82 is seated in each of the outer bores 168 (FIG.

10) in the spacer 74. The stem 192 of one of the members 80 is inserted in each spring, so that the body 190 sits on the spring. The spacer 74 having the members 80 and springs 82 assembled in this manner, is inserted in the counterbore 102, following the cylinder assembly. The members 80 are resiliently urged by the springs 82 against the bases of the barrel grooves 105, as illustrated in FIGS. 10 and 11, in the locking position of the cylinder 64, or against the wall surface bounding the counterbore 102, when the cylinder 64 is out of its locking position.

Following insertion of the spacer 74, the facing member 72 is inserted in the counterbore 102, and the cap 70 is secured on the front end of the barrel 62, by means of the split expansion ring 84, as described above, to permanently assemble the lock mechanism 34. The cap 70 is rotatable with respect to the barrel 62, while not being removable therefrom except by extreme measures. The cap opening 118, the facing member opening 162, the spacer opening 154, the slot 138, and portions of the tumbler bores 134 are in registry, so as to receive the key shank 38 for insertion thereof into engagement with the tumblers 66.

FIGS. 8, 10, and 12 illustrate the lock mechanism 34 in its locking condition. In this condition, the tumblers 66 are urged forward resiliently by the tumbler springs 68 to cause the front ends of the tumblers to abut on the rear surface of the spacer 74. The engagement members 76 are engaged by a land 175 of one or more of the tumblers 66 in each row, and possibly also by the curved surface defining a shallow tumbler groove 174 of one or more of the tumblers, so as to support each engagement member in an outer position with respect to the axes of the tumblers. Each engagement member in turn engages a locking member 78, in line contact therewith across the central inner edge portion 186 of the locking member, to support the locking member in a position projecting out from the cylinder groove 142 and into the registering barrel groove 105, thereby to interlock the cylinder 64 and the barrel 62. The locking member springs 79 serve to support the locking member 78 in parallel relation to the axis of the cylinder 64 and the coinciding axis of the barrel 62, with the locking member 78 abutting on the base of the barrel groove 105 therealong and providing locking engagement with the cylinder and the barrel along its length.

Figure 9:
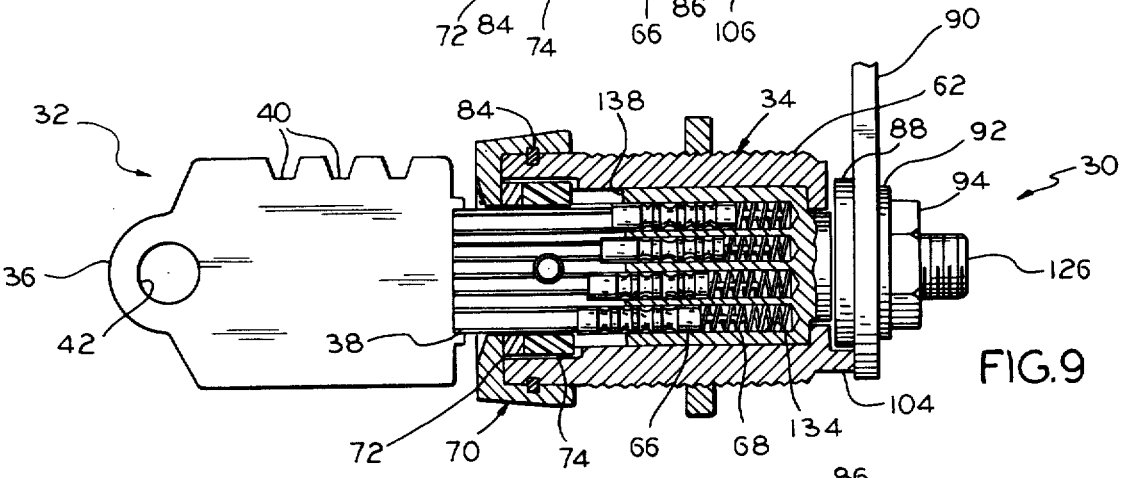
FIG. 9 is a view like FIG. 8, but illustrating the lock mechanism in condition for unlocking, with the key fully inserted.

The spacer 74 is interlocked with the cylinder 64, by means of the rear spacer lugs 148 engaging the cylinder in its longitudinal grooves 142. The key-holding members 80 are resiliently urged outwardly by their springs 82, so that the pointed outer ends of their bodies 190 are received in the barrel grooves 105. The facing member 72 is interlocked with the spacer 74, and thereby also with the cylinder 64, by the front spacer lugs 146 received in the facing member notches 160. Accordingly, the opening 162 in the facing member 72, the opening 154 in the spacer 74, and the slot 138 in the cylinder body 122 are aligned to permit insertion of the key shank 38 thereinto, as illustrated in FIGS. 9 and 11.

As the key shank 38 is inserted, the wards 164 of the facing member 72 and the wards 156 of the spacer 74 are received in the shank grooves 46, with the shank lands 44 received in the adjacent wider areas of the facing member opening 162. The enlarged lands 44*a* and 44*b* are received in the grooves 166 of the facing member. In this connection, enlarged lands such as those numbered 44*a* and 44*b* may be formed at one or more of various locations on the key shank 38, with grooves 166 correspondingly located in the facing member 72, to multiply the number of keys changes obtainable.

The key shank 38 is inserted through the opening 154 in the spacer 74, which opening is designed to accept all key shanks 38, whatever be the arrangement of enlarged lands such as 44*a* and 44*b*. The tips of the key-holding member stems 192 are received in the central grooves 46 on opposite sides of the key shank 38 as the shank is inserted. Upon complete insertion of the shank 38, the stems 192 are substantially aligned with the center of the retention hole 52 in the shank, which is located in line with the central grooves 46.

Insertion of the key 32 causes its shank 38 to enter the cylinder body slot 138, until the distal or outer end of the shank bottoms on the base of the slot 138. As the key is inserted, the portions of the front faces of the tumblers 66 which extend into the slot 138 are engaged by the bittings 48 on the key shank, in abutting relation. Following engagement, the tumblers 66 are moved inwardly for respective distances corresponding to the dispositions of the bittings 48 on the shank. When the key shank 38 has bottomed, the tumblers and associated elements are disposed substantially as illustrated in FIGS. 9, 11, and 13.

At this time, the deep grooves 176 in the tumblers 66 in each row are aligned transversely of the lock cylinder 64, in registry with one of the transverse slots 140 in the cylinder, to permit the engagement members 76 to move towards the tumblers by accepting them in the deep grooves 176. The locking members 78 remain in their projecting positions, by virtue of the forces exerted by their springs 79, but may be retracted from the projecting positions for unlocking purposes. It will be noted that the engagement members 76 are loose and may assume other positions in response to the force of gravity, depending upon the position of the lock assembly 30. The lock cylinder 64 may be rotated at this time, by turning the key 32, thereby rotating the locking plate 90 into a second position.

Rotation of the lock cylinder 64, clockwise in FIG. 14, changes the condition of the lock mechanism from that shown in FIGS. 9, 11, and 13 to the condition shown in FIGS. 14 and 15, which may be an intermediate or a final condition of the parts illustrated, depending upon the selected limits of rotation. Rotation of the cylinder 64 causes the locking members 78, which are under the pressure of their springs 79, to be cammed out of the barrel grooves 105, owing in this embodiment to the complementary convergent and divergent dispositions of the mating surfaces 180 and 105*a*, respectively. Similarly, the key-holding members 80, having their pointed bodies 190 initially in the barrel grooves 105, are cammed out of such grooves, whereby the inner ends of the stems 192 are projected into the retention hole 52 in the key shank 38. The key 32 then is trapped by the key-holding members 80 and cannot be pulled out of the lock mechanism.

When it is desired to restore the lock mechanism 34 to its locking condition, the cylinder 64 is rotated in the opposite, counterclockwise direction by corresponding rotation of the key 32, followed by removal of the key from the mechanism. The parts then return to their positions illustrated in FIGS. 8, 10, and 12.

As an alternative, suitable provision may be made for removal of the key 32 from the lock mechanism 34 while the lock is in its second condition, such as illustrated in FIGS. 14 and 15. Thus, suitable reliefs may be provided in the inner surface of the barrel counterbore 102, to permit the key-holding members 80 to move radially outwardly, to the extent shown in FIGS. 10 and 11, while their stems 192 are withdrawn from the retention hole 52 in the key shank 38. The key 32 then may be removed while the lock mechanism 34 is in such second condition.

As a further alternative, an additional pair or pairs of barrel grooves 105 may be provided, and be angularly related to the illustrated pair of grooves 105, so that the tumblers 66, the engagement members 76, and the locking members 78 may be restored to their locking dispositions, like the dispositions illustrated in FIGS. 8, 10, and 12, when the lock cylinder 64 is angularly disposed with respect to its initial locking disposition. Employing this alternative, the lock cylinder 64 is prevented from turning unless a proper key is inserted, in either of its described conditions. It is a feature of the invention that the construction of the lock mechanism permits the addition of such a pair or pairs of barrel grooves 105, essentially in any desired angular relation to the illustrative pair of grooves.

The lock mechanism 34 constituting a preferred embodiment of the invention is outstandingly pick-resistant and resistant to forcing, notably in the small sizes employed for vending machines, alarm systems, cabinets and the like. These characteristics are attributed in large part to the provision of elongate engagement members 76 and elongate locking members 78, which extend in different directions, intersecting in the preferred embodiments at about right angles, and also to the free-floating disposition or arrangement of the engagement members 76 and the locking members 78. Among other things, both the engagement members 76 and the locking members 78 are relatively free to tilt with respect to each other, with each fulcrumed centrally on the other. This ability or propensity is productive of a variety of results when attempts are made to pick the tumblers, with or without torquing the lock cylinder 64 with respect to the barrel 62. Tilting of the engagement members 76 may cause some tumblers 66 to bind while others are relatively free, thereby confusing and/or thwarting the would-be picker. Picking difficulties are compounded when torque is applied, which imparts a sideways tilt to the elongated locking members 78, accompanied by transmission of force from the locking members to the engagement members 76 in changing directions, which in turn affect the application of force by the engagement members 76 to the tumblers 66.

In addition to supporting the locking members 78 parallel to the cylinder axis, the locking member springs 79 support the members 78 so that no substantial pressure is exerted thereby on the engagement members 76, thereby minimizing any "feel" for picking.

The difficulties in picking produced by the foregoing structure are compounded with the tumblers 66 arranged in the two laterally spaced apart rows, and the provision of a transverse cylinder slot 140, an engagement member 76, a longitudinal cylinder groove 142, and a locking member 78 for each row of tumblers. Moreover, the illustrative manner of mounting the tumblers and the associated locking elements provides a compact lock mechanism. The mechanism may be made even more compact, if desired, by reducing the number of tumblers and tumbler bores in each row.

The striations 178 provided on the engagement members 76 serve to increase the binding effect of the members upon the tumblers 66, when such parts engage each other during a picking attempt, thereby mak. g picking even more difficult. However, the striation do not interfere with the normal operation of the lock, inasmuch as there are no high pressures existing between the locking elements. The shallow grooves 174 in the tumblers 66 function to give false indications of progress towards picking the tumblers, thereby confusing a would-be picker.

The key-holding members 80 serve both to trap the key 32, as described above, and to provide an anti-picking function when a tool or key other than a proper key is inserted into the lock mechanism. Thus, a tool of certain thickness and not having a void corresponding to the retention hole 52 in the key shank 38, when inserted in the opening 154 of the spacer 74, will block inward movement of the key-holding members 80, owing to abutment of their stems 192 against opposite surfaces of the inserted tool. Consequently, the pointed ends of the members 80 under normal circumstances will be prevented from moving out of the barrel grooves 105 upon attempted rotation of the cylinder 64. In view of the interlocking connection between the spacer 74 and the cylinder 64, achieved with the rear lugs 148 of the spacer, additional resistance to rotation of the cylinder 64 will be furnished by the resulting engagement of the key-holding members 80 with the barrel 62 in its grooves 105.

The wards 164 and the grooves 166 in the facing member 72 determine the configuration of the key shank 38 which may be inserted into the lock mechanism 34. The number and locations of the grooves 166 are varied among locks, to provide key changes additional to those provided by the different possible combinations of bittings 48 in the key shank 38. The wards 164 restrict the width of the facing member opening 162, to limit the accessibility to items other than proper keys. The facing member 72 and the spacer 74 space the front face 123 of the cylinder 64 away from the flange 116 of the cap 70, to make the location of the tumblers more remote and require a corresponding additional length of picking tool, which increases the difficulty in picking the lock mechanism.

The facing member 72 in the preferred structure is constructed of hard material resistant to drilling, e.g., steel hardened after providing the opening 162 therein. Such being the case, the spacer 74 preferably may be constructed of more economical material, which also may be formed economically. In preferred embodiments of the invention, the spacer 74 is formed of frangible material, such as thermoplastic material, as illustrated in the drawings. Consequently, either or both of the front and rear spacer lugs 146 and 148 may be broken off. If it be attempted to drill through the facing member 72, the front lugs 146 may break off, and the facing member 72 will rotate in the barrel 62, thus defeating the drilling attempt. The rear lugs 148 on the spacer will break off with the application of sufficient torque, applied to the facing member 72 with sufficient pressure thereon, or to the spacer 74, so that the spacer, as well as the facing member 72, will rotate in the barrel. Alternatively, or in addition thereto, with the spacer 74 made of suitable thermoplastic material, the spacer will fuse from the heat produced by drilling, to interfere with drilling and block access to the tumblers.

The cap 70 preferably is constructed of hard and tough material, which will resist attempts to break it or pry it away. Since the cap 70 is rotatably mounted on the barrel 62, the application of a wrench to the cap is of no avail in an attempt to force the lock.

The shoulder 103 on the inside of the barrel side wall 100, and the annular back wall 98 of the barrel serve to withstand attempts to drive the spacer 74 and the cylinder 64 to the rear, in any effort to punch out the internal parts of the mechanism.

The lock cylinder 64 in the preferred embodiment is advantageous in that it may be constructed in a single piece of material which is stronger than a cylinder made of a plurality of parts. An automatic machine may be employed to make the cylinder of metal. Alternatively, the cylinder 64 may be die-cast of suitable metal, or may be molded of plastic, where the circumstances of use permit, and additional economy is sought. The lock mechanism 34 is adapted for use with the illustrative key 32, which is advantageous in being time-consuming and expensive to copy while being manufactured readily, inexpensively, and with little waste of material on a production basis.

Figure 18:
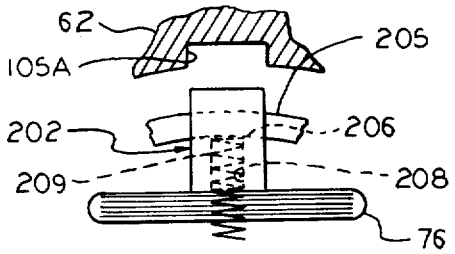
FIGS. 18 and 19 are, respectively, end and side elevational views of another embodiment of the locking member, shown partly broken away and in section in FIG. 19, illustrated in combination with the engagement member embodiment of the preceding views.
Figure 19:
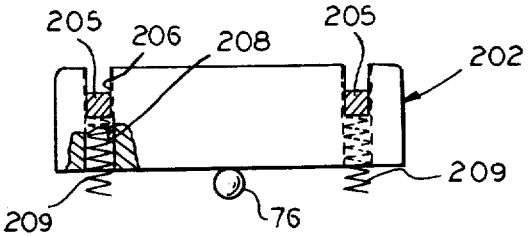
Figure 20:
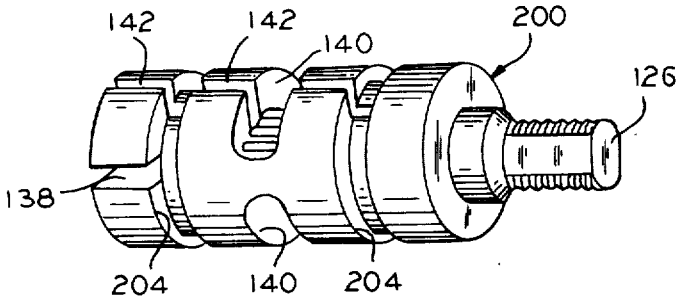
FIG. 20 is a perspective view of another embodiment of the lock cylinder, which is employed with the members of FIGS. 18 and 19, the cylinder being illustrated on a smaller scale than the structures of the latter views.

FIGS. 18, 19, and 20 illustrate structural changes which may be made, for the purpose of withdrawing locking members from the barrel grooves when the key is inserted in the lock mechanism. The illustrative structure enables grooves 105A to be formed in the barrel with a rectangular cross section, and the locking members to have a like rectangular cross section, thereby providing even greater resistance to torque applied to the lock cylinder.

In FIGS. 18–20 a modified lock cylinder 200, a modified locking member 202, and an engagement member 76, as previously described, are illustrated. The lock cylinder 200 is constructed like the cylinder 64 of the first embodiment, with the addition of two spaced parallel transverse peripheral grooves 204, sized to receive therein a split-ring spring 205. The locking member 202 includes two spaced parallel transverse grooves 206 which receive therein the foregoing split-ring spring 205, and, upon entry of the locking member into a longitudinal cylinder groove 142, align or register with the transverse cylinder grooves 204. The locking member 202 also is provided with two spaced parallel spring bores 208, which extend between the inner and outer edges of the locking member and intersect the transverse grooves 206. The spring bores 208 serve to receive coil compression springs 209 like the locking member springs 79 illustrated for the first embodiment. The inwardly exerted force of the split-ring springs 205, in the transverse grooves 204 and 206, is selected so as to be greater than the outwardly directed force of the coil compression springs 209 inserted in the bores 208, but less than the sum of the outwardly directed forces exerted by the compression springs 209 in the bores 208 and the tumbler springs 68 acting through the tumblers 66 against the engagement members 76.

With the foregoing structure, the locking member 202 is urged outwardly into the longitudinal barrel groove 105A, corresponding to the longitudinal grooves 105 in the first embodiment, when the lock mechanism is in its locking condition. Insertion of the key 32 in engagement with the tumblers 66 nullifies the combined forces of the tumbler springs 68, whereupon the split-ring springs 205 overcome the forces of the coil springs 209, to withdraw the locking member 202 from the barrel groove 105A, and permit the lock cylinder 200 to rotate. With such means for withdrawal of the locking member 202, there is no need for camming structure to move the locking member from the barrel groove, which then can be square and cooperate with a square edge on the locking member for optimum locking engagement.

Figure 21:
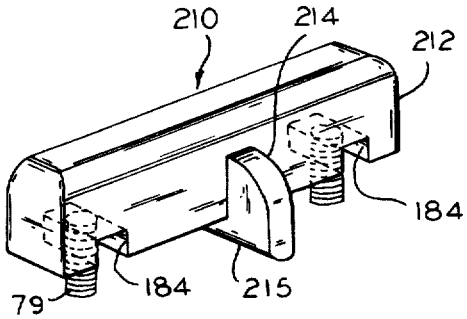
FIG. 21 is a perspective view of a locking element structure of integral engagement and locking members, employed in an additional embodiment of the invention.

FIG. 21 illustrates locking elements in accordance with the invention which are integrally united in a one-piece assembly. Thus, a free-floating composite locking element structure 210 includes a locking member 212 similar to the locking member 78 of the first embodiment, and an engagement member 214 generally in the form of a segment of a circle, which is united with the locking member in perpendicular relation thereto. A rounded tumbler-engagement edge 215 is provided on the engagement member 214. The structure is employed with locking member springs 79 received in recesses 184, as in the first embodiment. The structure of FIG. 21 provides advantages like those of the separate locking elements 76 and 78 of the first embodiment, and is easier to assemble in the lock mechanism. However, it is lacking in the ability of two elements to move relatively to each other, and it is more expensive to make.

Figure 22:
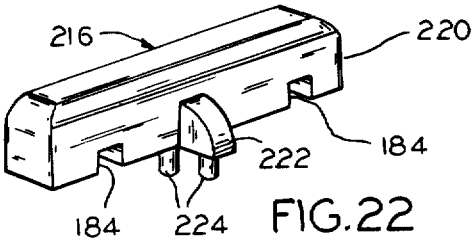
FIG. 22 is a perspective view of a locking element structure of integral engagement and locking members, employed in a further embodiment of the invention.
Figure 23:
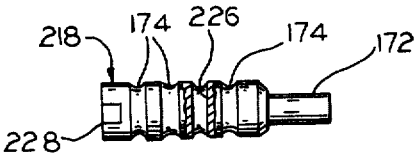
FIG. 23 is a side elevational view with a portion broken away and in section, of another embodiment of the tumbler, such as may be employed in combination with the structure of FIG. 22.

FIG. 22 illustrates a locking element structure 216 similar to the structure 210 of FIG. 21 in certain respects, and FIG. 23 illustrates a tumbler 218 which may be employed therewith. The structure 216 includes a locking member 220 which is like the locking member 212 of FIG. 21 and has spring-receiving recesses 184, and an engagement member 222 replacing the engagement member 214 of FIG. 21. The engagement member 222 differs essentially in the inclusion of a row of engagement pins 224 projecting outwardly in a plane from the body of the member 222. The tumbler 218 is provided with a crossbore 226 between shallow circumferential grooves 174. The crossbore 226 serves to receive one of the pins 224 when in alignment therewith, as obtained upon insertion of the key 32 into the lock mechanism. The tumbler 218 may be prevented from rotating in its bore by a tang 228, which extends for a small fraction of the overall length of the tumbler 218, adjacent to the front end thereof, and serves to engage a corresponding groove, not illustrated, formed in the wall of the tumbler bore adjacent to its front end.

In both of the structures of FIGS. 21 and 22, there is the advantage that the locking element structure is more readily located properly in the assembled lock mechanism. The structures of FIG. 22 and 23 introduce an additional difficulty in picking, in that the engagement pins 224 must be properly aligned with the tumbler crossbores 226, whereas torquing of the lock cylinder causes the locking member 220 to tilt or cant laterally with corresponding tilting of the pins 224. As in the case of the structure 210 of FIG. 21, the members 220 and 222 in the structure of FIG. 22 are lacking in the ability to move relative to each other and are more expensive. Also, tolerances must be closer. Nevertheless, the advantages can outweigh the disadvantages under certain circumstances.

Figure 24:
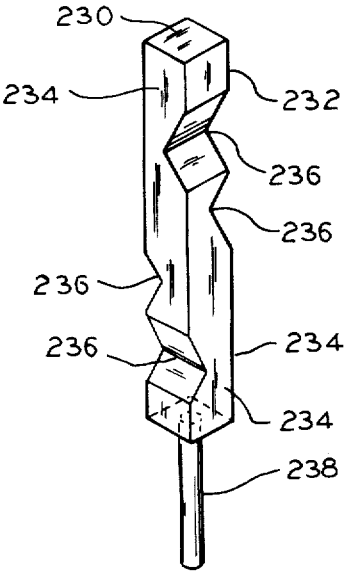
FIG. 24 is a perspective view of a further embodiment of the tumbler, which is employed with a modified lock cylinder in the lock mechanism.
Figure 25:
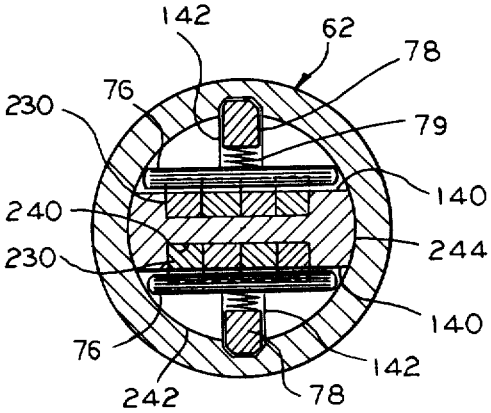
FIG. 25 is a cross-sectional view similar to FIG. 13, of the lock mechanism employing tumblers as illustrated in FIG. 24 in a modified lock cylinder.

FIGS. 24 and 25 illustrate the use of tumblers 230 having bodies 232 of generally right rectangular parallelepipedal configuration, which bodies have a square cross section and rectangular side faces 234. A V-shaped transverse engagement member-receiving groove 236 is provided in each face 234. A stem 238 of cylindrical configuration is integral with and axially extends from one end of the tumbler body 232.

The tumblers 230 are received in a pair of spaced parallel longitudinal bores 240 in the body 242 of a lock cylinder 244, otherwise constructed like the cylinder 64 of the first embodiment. The bores 240 have rectangular cross sections, and each receives closely therein a row of four tumblers 230 in closely adjacent side-by-side relation, permitting the tumblers to move individually or together, longitudinally and reciprocally in the bores.

In the manner of the preceding embodiments, two transverse slots 140 and two longitudinal grooves 142 are provided in the cylinder body 242. The slots 140 intersect the bores 240, to expose the tumblers 230, and the grooves 142 intersect the slots 140. As in the preceding embodiments, the engagement members 76 are received in the slots 140, and the locking members 78 are received in the grooves 142. Upon alignment of the grooves 236 in outer coplanar faces 234 of the several tumblers 230 in each bore 240, the adjacent engagement member 76 is received in the aligned grooves for unlocking purposes, similarly to the functioning of the tumblers 66 in the first embodiment.

Advantages of the structure of FIGS. 24 and 25 include the ability to locate the grooves 236 in differing longitudinal positions, as in the illustrative embodiment, so that different lock codes are made available simply by turning the tumblers 230 in their bores, to change the faces 234 thereof which are presented to the adjacent engagement member 76. As in the preceding embodiments, relatively shallow false picking grooves, not illustrated, also may be provided in the tumbler faces 234.

For master-keying purposes or the like, more than one deep groove 176 may be provided in the tumbler 66 of the first embodiment, more than one crossbore 226 may be provided in the tumbler 218 of FIG. 23, and more than one transverse groove 236 may be provided in each face 234 of the tumbler 230 of FIG. 24, in differing longitudinal dispositions.

While in the illustrative preferred embodiments, the spacer 74 having the lugs 146 and 148 provides frangible means cooperating with the cylinder 64 and the facing member 72 to orient the spacer and the facing member, it will be apparent that other frangible means may be employed. Thus, for example, breakable lugs or pins may be provided on the facing member 72 and/or on the cylinder 64, and extend into engagement with the spacer 74, so as to break off upon the application of excessive torque. It will also be apparent to those skilled in the art that various other changes and modifications may be made in the illustrative embodiments, within the spirit and scope of the invention. It is intended that all such changes and modifications be included within the scope of the appended claims.

I claim:

1. A cylinder lock mechanism which comprises:

a tubular barrel, a lock cylinder received in said barrel for rotation about the longitudinal axis of the cylinder and having tumbler bore-forming means extending longitudinally therein, a plurality of tumblers received in said bore-forming means for reciprocal longitudinal movement therein, a cap secured to a front end of the barrel and having an opening for insertion of a key therethrough, a discrete facing member received in said barrel for rotation about said axis and interposed between said cap and said cylinder, said facing member having an opening arranged for registry with said cap opening and with said bore-forming means, and said facing member comprising hard material resistant to drilling, a discrete spacer received in said barrel for rotation about said axis and interposed between said facing member and said cylinder, said spacer having an opening arranged for registry with said cap opening and with said bore-forming means, said openings when in said registry receiving a key for insertion thereof into engagement with said tumblers, an engagement member extending transversely of said cylinder for engagement with said tumblers and laterally movable to and from the tumblers, an elongated locking member extending longitudinally of said cylinder for engagement with said engagement member and laterally movable to and from said tumblers, means on said cylinder and said barrel respectively for engaging said locking member along its length for locking purposes, means on each of said tumblers for engaging said engagement member to support said locking member in a projecting position with respect to said cylinder and in engagement with said locking member-engaging means on said barrel for locking purposes, and means on each of said tumblers permitting said engagement member to move towards the tumblers, thereby to permit retraction of said locking member from said projecting position for unlocking purposes, said engagement member and said locking member being free-floating in the lock mechanism such that said engagement and locking members are free to tilt in respective directions transverse to each other.

2. A cylinder lock mechanism as defined in claim 1 and including frangible means for orienting said facing member and said spacer angularly with respect to said cylinder.

3. A lock mechanism as defined in claim 2 and including a key-holding member mounted for reciprocal transverse movement in said spacer between a position wherein an outer end of the member projects outwardly from the spacer and a position wherein an inner end of the member projects into said spacer opening, means resiliently biasing said key-holding member outwardly, and means on said barrel interlocking with said outer end of the key-holding member when projecting outwardly from said spacer.

4. A lock mechanism as defined in claim 1, 2 or 3 and including two laterally spaced apart rows of said tumblers, and for each of said rows, a separate combination of such an engagement member, such a locking member, and such locking member-engaging means on said cylinder and said barrel.

5. A lock mechanism as defined in claim 1, 2 or 3 and including means forming a transverse slot in said cylinder in communication with said tumblers and receiving said engagement member therein, means forming a longitudinal groove in the outer surface of said cylinder in communication with said engagement member and receiving said locking member therein, and means forming a longitudinal groove in the inner surface of said barrel arranged for registry with said cylinder groove and receiving said locking member therein, each of said grooves being bounded by a pair of opposed flat side walls comprising respective said locking member-engaging means, said locking member having opposite flat side surfaces arranged for locking engagement with respective said pairs of side walls.

6. A lock mechanism as defined in claim 5 and wherein a row of spaced apart cylindrical bores is formed by said tumbler bore-forming means, said tumblers comprise cylindrically-shaped bodies received in said bores, said engagement member comprises a discrete cylindrically-shaped body, and said engagement member movement-permitting means comprises a circumferential groove on each tumbler receiving the engagement member therein.

7. A cylinder lock mechanism which comprises:

a tubular barrel, a lock cylinder received in said barrel for rotation about the longitudinal axis of the cylinder and having a row of spaced apart cylindrical tumbler bores extending longitudinally therein, a tumbler comprising a cylindrically-shaped body received in each of said bores for reciprocal longitudinal movement therein, a cap rotatably secured to a front end of the barrel and having an opening for insertion of a key therethrough, a discrete facing member received in said barrel for rotation about said axis and interposed between said cap and said cylinder, said facing member having an opening arranged for registry with said cap opening and with said bores, and said facing member comprising hard material resistant to drilling, a discrete spacer received in said barrel for rotation about said axis and interposed between said facing member and said cylinder, said spacer having an opening arranged for registry with said cap opening and with said bores, said openings when in said registry receiving a key for insertion thereof into engagement with said tumblers, means forming a transverse slot in said cylinder in communication with said tumblers, an engagement member received in said slot for engagement with said tumblers and laterally movable in the slot to and from the tumblers, means forming a longitudinal groove in the outer surface of said cylinder in communication with said engagement member, an elongated locking member received in said groove for engagement with said engagement member and laterally movable to and from said tumblers, means forming a longitudinal groove in the inner surface of said barrel arranged for registry with said cylinder groove to receive said locking member in both grooves in engagement with the cylinder and the barrel along the length of the locking member for interlocking the cylinder and the barrel, means on each of said tumblers for engaging said engagement member to support said locking member in a position projecting from said cylinder and into said barrel groove for locking purposes, and means on each of said tumblers permitting said engagement member to move towards the tumblers, thereby to permit retraction of said locking member from said projecting position for unlocking purposes, said engagement member and said locking member being free-floating in the lock mechanism such that said engagement and locking members are free to tilt in respective directions transverse to each other.

8. A lock mechanism as defined in claim 7 and wherein said engagement member movement-permitting means comprises a circumferential groove on each tumbler, said engagement member comprises a discrete cylindrically-shaped body received in the tumbler grooves, said locking member has opposite flat side surfaces, and each of said cylinder and barrel grooves is bounded by a pair of opposed flat side walls arranged for locking engagement with said side surfaces.

9. A lock mechanism as defined in claim 8 and including two laterally spaced apart such rows of tumbler bores having such a tumbler in each bore, and for each of said rows, a separate combination of such engagement member, such a locking member, such slot-forming means, and such cylinder and barrel groove-forming means.

10. A lock mechanism as defined in claim 7, 8, or 9 and including a key-holding member mounted for reciprocal transverse movement in said spacer between a position wherein an outer end of the member projects outwardly from the spacer and a position wherein an inner end of the member projects into said spacer opening, means resiliently biasing said key-holding member outwardly, and means on said barrel interlocking with said outer end of the key-holding member when projecting outwardly from said spacer.

11. In a cylinder lock mechanism, the combination of:

a lock cylinder having tumbler bore-forming means therein extending in the direction of its longitudinal axis, a plurality of tumblers received in said bore-forming means for reciprocal longitudinal movement therein, an engagement member extending transversely of said cylinder for engagement with said tumblers and laterally movable to and from the tumblers, an elongated locking member extending longitudinally of said cylinder for engagement with said engagement member and laterally movable to and from said tumblers, means on said cylinder for engaging said locking member along its length for locking purposes, means on each of said tumblers for engaging said engagement member to support said locking member in a projecting position with respect to said cylinder for locking purposes, and means on each of said tumblers permitting said engagement member to move towards the tumblers, thereby to permit retraction of said locking member from said projecting position for unlocking purposes, said engagement member and said locking member being free-floating in the lock mechanism such that said engagement and locking members are free to tilt in respective directions transverse to each other.

12. A lock mechanism as defined in claim 11 and including means forming a transverse slot in said cylinder in communication with said tumblers and receiving said engagement member therein, said locking-member engaging means on said cylinder comprising means forming a longitudinal groove in the outer surface of said cylinder in communication with said engagement member and receiving said locking member therein.

13. A lock mechanism as defined in claim 12 and wherein a row of spaced apart cylindrical tumbler bores is formed by said tumbler bore-forming means, and said tumblers comprise cylindrically-shaped bodies received in said bores.

14. A lock mechanism as defined in claim 13 and including two laterally spaced apart such rows of tumbler bores each having such a tumbler in each bore, and for each of said rows, a separate combination of such an engagement member, such a locking member, and such locking member-engaging means.

15. A lock mechanism as defined in claim 14 and wherein said engagement member movement-permitting means comprises a circumferential groove on each tumbler, said engagement member comprises a discrete cylindrically-shaped body received in the tumbler grooves, said cylinder groove is bounded by opposed flat side walls comprising said locking member-engaging means, and said locking member has opposite flat side surfaces arranged for locking engagement with said side walls.

16. A lock mechanism as defined in claim 15 and including means forming longitudinally extending striations in the outer surface of said engagement member.

17. A lock mechanism as defined in claim 11 or 12 and wherein said tumblers include bodies having a square cross sections and rectangular side faces, and said engagement member movement-permitting means comprises a transverse groove in each of said faces.

18. In a cylinder lock mechanism, the combination of:

a lock cylinder having a row of spaced apart cylindrical tumbler bores therein extending in the direction of its longitudinal axis, a tumbler comprising a cylindrically-shaped body received in each of said bores for reciprocal longitudinal movement therein, means forming a transverse slot in said cylinder in communication with said tumblers, a discrete engagement member received in said slot for engagement with said tumblers and laterally movable in the slot to and from the tumblers, means forming a longitudinal groove in the outer surface of said cylinder in communication with said engagement member, a discrete elongated locking member received in said groove for engagement with said engagement member and laterally movable to and from the tumblers, said locking member engaging said cylinder in said groove along the length of the locking member for locking purposes, means on each of said tumblers for engaging said engagement member to support said locking member in a projecting position with respect to said cylinder for locking purposes, and means on each of said tumblers permitting said engagement member to move towards the tumblers, thereby to permit retraction of said locking member from said projecting position for unlocking purposes, said engagement member and said locking member being free-floating in the lock mechanism such that said engagement and locking members are free to tilt in respective directions transverse to each other.

19. A lock mechanism as defined in claim 18 and including an additional such row of tumbler bores having such a tumbler in each bore, said rows being spaced apart laterally, and for said additional row, an additional combination of such slot-forming means, such an engagement member, such groove-forming means, and such a locking member.

20. A lock mechanism as defined in claim 18 or 19 and wherein said engagement member movement-permitting means comprises a circumferential groove on each tumbler, said engagement member comprises a cylindrically-shaped body received in the tumbler grooves, said cylinder groove is bounded by opposed flat side walls, and said locking member has opposite flat side surfaces arranged for locking engagement with said side walls.

21. A lock mechanism as defined in claim 20 and including means forming longitudinally extending striations in the outer surface of said engagement member.

22. A lock mechanism as defined in claim 20 and including means resiliently biasing said locking member into said projection position.

23. In a cylinder lock mechanism including a tubular barrel, a lock cylinder received in the barrel for rotation about the longitudinal axis of the cylinder and having tumbler bore-forming means extending longitudinally therein, a plurality of tumblers received in said bore-forming means for reciprocal longitudinal movement therein, and a cap secured to a front end of the barrel and having an opening for insertion of a key therethrough, the combination of:

a discrete facing member received in said barrel for rotation about said axis and interposed between said cap and said cylinder, said facing member having an opening arranged for registry with said cap opening and with said bore-forming means, and said facing member comprising hard material resistant to drilling, frangible means for orienting said facing member angularly with respect to said cylinder, and a discrete spacer received in said barrel for rotation about said axis and interposed between said facing member and said cylinder, said spacer having an opening arranged for registry with said cap opening and with said bore-forming means, said openings when in said registry receiving a key for insertion thereof into engagement with said tumblers.

24. A lock mechanism as defined in claim 23 and wherein said frangible means comprises means interlocking said facing member and said spacer, and means interlocking said spacer and said cylinder.

25. A lock mechanism as defined in claim 24 and wherein said spacer comprises a frangible member which includes lugs respectively extending forwardly and rearwardly, and said facing member and said cylinder each include means providing recesses receiving said lugs, thereby to provide said first and second-named interlocking means, respectively.

26. A lock mechanism as defined in claim 23, 24 or 25 and wherein said cap is rotatable on said barrel.

27. A lock mechanism as defined in claim 23, 24 or 25 and including a key-holidng member mounted for reciprocal transverse movement in said spacer between a position wherein an outer end of the member projects outwardly from the spacer and a position wherein an inner end of the member projects into said spacer opening, means resiliently biasing said key-holding member outwardly, and means on said barrel interlocking with said outer end of the key-holding member when projecting outwardly from said spacer.

28. A lock mechanism as defined in claim 27 and wherein said cap is rotatable on said barrel.

29. In a cylinder lock mechanism including a tubular barrel, a lock cylinder received in the barrel for rotation about the longitudinal axis of the cylinder and having tumbler bore-forming means extending longitudinally therein, a plurality of tumblers received in said bore-forming means for reciprocal longitudinal movement therein, and a cap secured to a front end of the barrel and having an opening for insertion of a key therethrough, the combination of:

a discrete member received in said barrel for rotation about said axis and interposed between said cap and said cylinder, said member having an opening arranged for registry with said cap opening and with said bore-forming means to receive a key for insertion thereof into engagement with said tumblers, and frangible means for orienting said member angularly with respect to said cylinder.

30. A lock mechanism as defined in claim 29 and including means for interengaging said member and said cylinder to provide said orientation, said frangible means including means yielding to the application of torque to said member whereby the member and the cylinder become disengaged to permit relative rotation therebetween.

31. A lock mechanism as defined in claim 29 and wherein said member is frangible and includes lug means for interengaging said member and said cylinder to provide said orientation, thereby to provide said frangible means, said lug means yielding to the application of torque to said member whereby the member and the cylinder become disengaged to permit relative rotation therebetween.

32. In a cylinder lock mechanism including a tubular barrel, a lock cylinder received in the barrel for rotation about the longitudinal axis of the cylinder and having tumbler bore-forming means extending longitudinally therein, a plurality of tumblers received in said bore-forming means for reciprocal longitudinal movement therein, and a cap secured to a front end of the barrel and having an opening for insertion of a key therethrough, the combination of:

a discrete facing member received in said barrel for rotation about said axis and interposed between said cap and said cylinder, said facing member having an opening arranged for registry with said cap opening and with said bore-forming means, and said facing member comprising hard material resistant to drilling, a discrete spacer received in said barrel for rotation about said axis and interposed between said facing member and said cylinder, said spacer having an opening arranged for registry with said cap opening and with said bore-forming means, and frangible means for orienting said spacer angularly with respect to said cylinder, said openings when in said registry receiving a key for insertion thereof into engagement with said tumblers.

33. A lock mechanism as defined in claim 32 and wherein said cap is rotatable on said barrel.

34. A lock mechanism as defined in claim 32 and including a key-holding member mounted for reciprocal transverse movement in said spacer between a position wherein an outer end of the member projects outwardly from the spacer and a position wherein an inner end of the member projects into said spacer opening, means resiliently biasing said key-holding member outwardly, and means on said barrel interlocking with said outer end of the key-holding member when projecting outwardly from said spacer.

35. A lock mechanism as defined in claim 34 and wherein said cap is rotatable on said barrel.

36. In a cylinder lock mechanism, the combination of:

a tubular barrel, a lock cylinder received in said barrel for rotation about the longitudinal axis of the cylinder and having tumbler bore-forming means extending longitudinally therein, a plurality of tumblers received in said bore-forming means for reciprocal longitudinal movement therein, an engagement member extending transversely of said cylinder for engagement with said tumblers and laterally movable to and from the tumblers, an elongated locking member extending longitudinally of said cylinder for engagement with said engagement member and laterally movable to and from said tumblers, means on said cylinder and said barrel respectively for engaging said locking member along its length for locking purposes, means on each of said tumblers for engaging said engagement member to support said locking member in a projecting position with respect to said cylinder and in engagement with said locking member-engaging means on said barrel for locking purposes, and means on each of said tumblers permitting said engagement member to move towards the tumblers, thereby to permit retraction of said locking member from said projecting position for unlocking purposes, said engagement member and said locking member being free-floating in the lock mechanism such that said engagement and locking members are free to tilt in respective directions transverse to each other.

* * * * *